US008495941B2

(12) United States Patent
Farid et al.

(10) Patent No.: US 8,495,941 B2
(45) Date of Patent: Jul. 30, 2013

(54) SECTIONING DEVICE AND METHOD OF USE

(76) Inventors: Tariq Farid, Cheshire, CT (US); Kamran Farid, Cheshire, CT (US)

( * ) Notice: Subject to any disclaimer, the term of this patent is extended or adjusted under 35 U.S.C. 154(b) by 609 days.

(21) Appl. No.: 12/248,347

(22) Filed: Oct. 9, 2008

(65) Prior Publication Data

US 2009/0193952 A1 Aug. 6, 2009

Related U.S. Application Data

(60) Provisional application No. 61/025,538, filed on Feb. 1, 2008.

(51) Int. Cl.
*B26D 5/08* (2006.01)

(52) U.S. Cl.
USPC ..... 83/620; 83/630; 83/633; 83/932; 30/114; 30/299; 30/302

(58) Field of Classification Search
USPC 30/113.1–113.3, 114, 299, 301–303; 83/932, 83/620, 627, 630, 633; 99/537–539, 554, 99/314–316
See application file for complete search history.

(56) References Cited

U.S. PATENT DOCUMENTS

| | | | |
|---|---|---|---|
| 98,457 | A | 12/1869 | Wright |
| 182,133 | A | 9/1876 | Rogers |
| 419,722 | A | 1/1890 | Siersdorfer |
| 471,158 | A | 3/1892 | Westerman |
| 507,383 | A | 10/1893 | O'Connell |
| 590,129 | A | 9/1897 | Bulette |
| 609,368 | A | 8/1898 | Lawson |
| 853,796 | A | 5/1907 | Imes |
| 1,250,676 | A | 12/1917 | Segerc |
| 1,399,950 | A | 12/1921 | Fish |
| 1,422,066 | A | 7/1922 | Vafiades et al. |
| 1,438,925 | A | 12/1922 | Lawrence |
| 1,479,369 | A | 1/1924 | Chounis |
| 1,744,422 | A | 1/1930 | Taylor |
| D108,326 | S | 2/1938 | Grow |
| 2,373,781 | A | 4/1945 | Richardson |
| 3,060,838 | A | 10/1962 | Priore |
| 3,468,355 | A | 9/1969 | Hall |
| 3,830,151 | A | 8/1974 | Gerson |
| 3,924,501 | A | 12/1975 | Cohen et al. |
| 4,436,025 | A | 3/1984 | Jones |
| 4,573,384 | A | 3/1986 | Jones |
| D298,790 | S | 12/1988 | Hutchinson |
| 4,911,045 | A | 3/1990 | Mendenhall |

(Continued)

FOREIGN PATENT DOCUMENTS

| | | |
|---|---|---|
| GB | 319497 | 9/1929 |
| GB | 2286110 | 8/1995 |
| GB | 2312613 | 11/1997 |
| WO | 93/10948 | 6/1993 |

*Primary Examiner* — Phong Nguyen

(57) ABSTRACT

A sectioning device for sectioning food and non-food items includes a frame, a cutter removably positioned on the frame and press means positioned on the frame for pushing an item against and through the cutter. The sectioning device also includes means for moving, in a single continuous motion, at least one of the cutter and the press means between a neutral position and a sectioning position. The press means and the cutter are configured such that an item to be sectioned, positioned between the cutter and the press means is sectioned in its entirety upon movement from the neutral position to the sectioning position.

1 Claim, 4 Drawing Sheets

U.S. PATENT DOCUMENTS

| | | | | |
|---|---|---|---|---|
| 5,018,419 | A | 5/1991 | Omura | |
| 5,142,973 | A | 9/1992 | Tur et al. | |
| 5,337,480 | A | 8/1994 | Codikow | |
| 5,363,756 | A | 11/1994 | Muro | |
| 5,373,781 | A | 12/1994 | Knasel | |
| 5,421,249 | A | 6/1995 | Repisky et al. | |
| 5,520,105 | A | 5/1996 | Healy | |
| 5,873,294 | A | 2/1999 | Sciuto | |
| 6,318,225 | B1 * | 11/2001 | Longoria | 83/454 |
| 6,748,854 | B2 | 6/2004 | Barnard | |
| 2003/0079616 | A1 * | 5/2003 | Barnard | 99/537 |
| 2007/0044619 | A1 | 3/2007 | Farid et al. | |

* cited by examiner

SECTIONING DEVICE AND METHOD OF USE

CROSS-REFERENCE TO RELATED APPLICATIONS

This application claims the benefit of U.S. Provisional Application No. 61/025,538, filed on Feb. 1, 2008, and entitled "Fruit Cutter", which is hereby incorporated by reference in its entirety. U.S. patent application Ser. No. 11/218,104, entitled "Melon Wedger", filed on Sep. 1, 2005 is also hereby incorporated by reference in its entirety.

BACKGROUND

1. Field

The present invention is generally directed to the cutting of food and non-food items and is more specifically directed to a device for sectioning such food and non-food items into desired shapes.

2. Related Art

It is well known that food items such as fruit can be cut or sectioned by a knife. Utilization of knives to cut or section food items can be time consuming, physically exhausting and dangerous. Previous attempts to overcome these downfalls have resulted in devices that are large, cumbersome, and often not easily portable. Furthermore, the devices are often still physically exhausting and dangerous when placed into use.

Accordingly, the inventors recognize that a need exists for an improved apparatus and method for cutting or sectioning food or non-food items.

SUMMARY

According to aspects illustrated herein, a device for sectioning food and non-food items includes a frame, a cutter removably positioned on the frame and press means positioned on the frame for pushing an item against and through the cutter. The sectioning device also includes means for moving, in a single continuous motion, at least one of the cutter and the press means between a neutral position and a sectioning position. The press means and the cutter are configured such that an item to be sectioned, when positioned between the cutter and the press means is sectioned and/or cut in its entirety upon movement of the press means or cutter from the neutral position to the sectioning position.

The cutter can include a plurality of blades positioned to section the food or non-food item into a desired shape. Voids are defined between the blades. To push the item to be sectioned, through the cutter, the press means includes fingers adapted to extend into the voids when the press means moves to the sectioning position.

According to other aspects illustrated herein, there is provided a sectioning device wherein the press means is removably positioned on the frame. The press means includes a support movably positioned on the frame and a press module removably positioned on the support. A detent mechanism can be employed to retain the press means on the support. The above-described fingers extend from the press module. Different press modules can be provided to correspond to differently configured cutters.

The means for moving can include any one or more of a number of different actuator devices and mechanisms. For example, a pneumatic cylinder could be coupled to the press means and, upon activation, causes the pushing means to move between the neutral and sectioning positions. In another embodiment, a motor, stepper or otherwise, can be coupled to the frame, and via an arm handle, or other linkage engages the press means so that during operation, the rotary motion imparted by the motor causes the press means to move between the neutral and sectioning positions. The means for moving can also include a manually actuated handle. Regardless of the means for moving, movement of the press means from the neutral to the sectioning position can be accomplished in one smooth continuous motion.

The present application includes a method of sectioning an item using the above described sectioning device. The method includes positioning the item to be sectioned between the cutter and the press means. The means for moving is moved in a single continuous motion, such that the means for moving and at least one of the cutter and the press means moves between a neutral position and a sectioning position to section and/or cut the item in its entirety. One advantage of the method is that an operator can apply a force to the means for moving using both hands. Such an operation ensures that the operator's hands are a safe distance away from the cutter.

DETAILED DESCRIPTION

Figure 1:
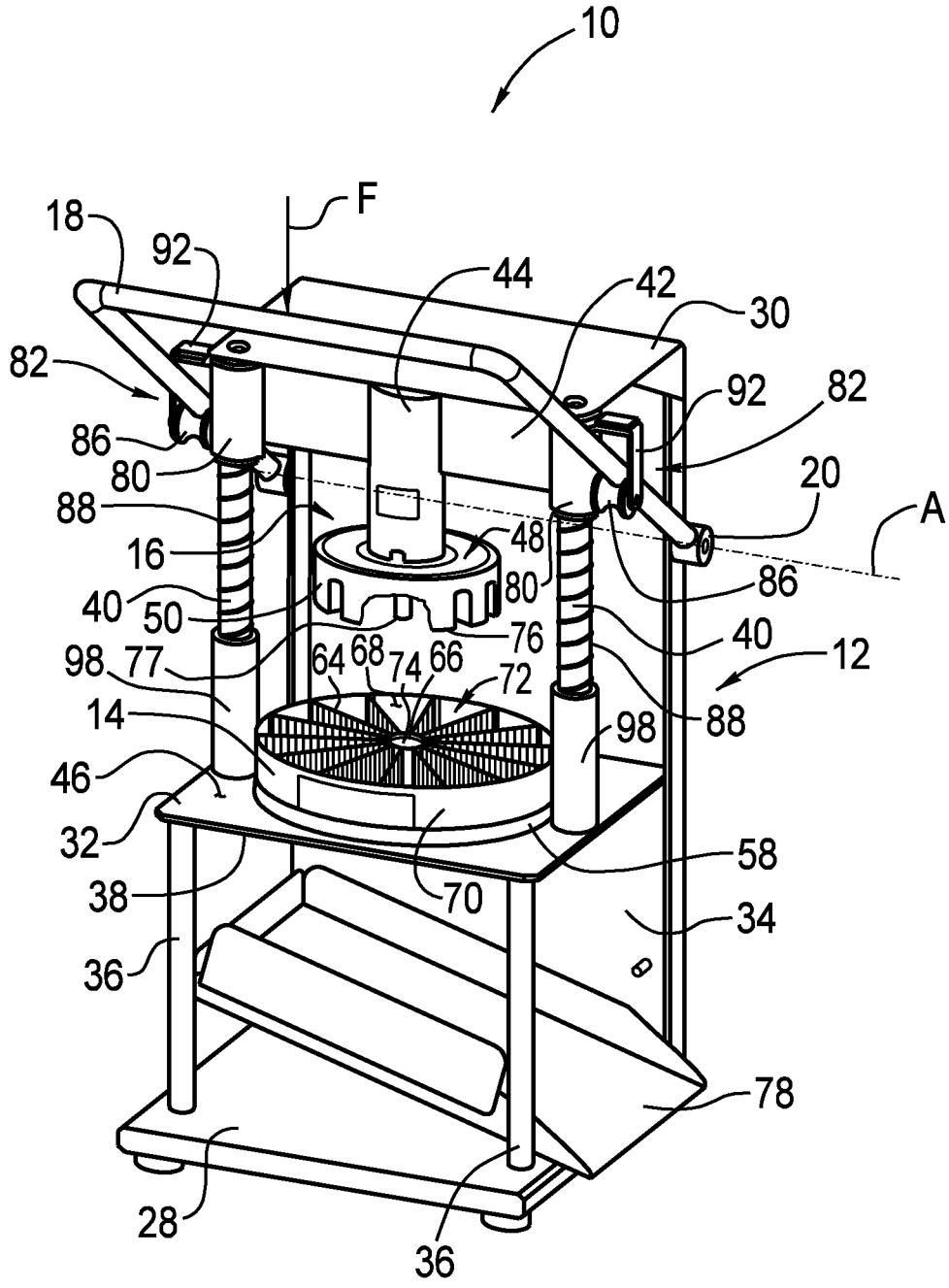
FIG. 1 is a front perspective view of the sectioning device with a handle.

As shown in FIG. 1, a sectioning device for sectioning food and other items (not shown, but can include, for example, fruits such as melons, pears, pineapples, apples; vegetables such as eggplant and zucchini; breads and doughs; and non food items such as wood, plastic and Styrofoam®) is generally designated by the reference number 10. The sectioning device 10 includes a frame 12 and a cutter 14 removably positioned on the frame. The sectioning device 10 also includes a press assembly 16 movably positioned on the frame 10 for pushing an item to be sectioned against and through the cutter 14. The sectioning device 10 further includes a handle 18 pivotally coupled to the frame 10 for movement between a neutral position and a sectioning position. Movement of the handle 18, (as explained in greater detail below) causes the press assembly to move generally rectilinearly between the neutral and sectioning position.

The device 10 of the present invention is configured so that the above-described movement of the press assembly 16 between the neutral and sectioning positions can be accomplished in one smooth continuous motion. The device 10 is further configured so that an item, to be sectioned, placed between the press assembly 16 and the cutter 14 is pushed through the cutter, thereby causing the entirety of the item to be sectioned.

As shown in the illustrated embodiment, the handle 18 is generally u-shaped and is pivotally coupled at two generally opposing positions to the frame thereby causing the handle to be rotatable about a pivot axis A. A portion of the handle 18 slidably engages the press assembly 16 to effect movement thereof between the neutral and sectioning positions.

While a u-shaped handle 18 has been shown and described, the sectioning device 10 is not limited in this regard as other handle shapes and configurations can be employed without departing from the broader aspects of the sectioning device. Moreover, while the handle 18 has been shown and described as being pivotably attached to the frame at two generally opposing points, the sectioning device is not limited in this regard as a single pivot location can be employed. Moreover, mechanisms for moving the press assembly, other than the handle 18, and/or the cutter between the neutral position and the sectioning position can be employed, including, but not limited to, motors, steppers motors, pneumatic cylinders, diaphragm actuators, lead screws, rack and pinions, belt drives and cam mechanisms.

Figure 2:
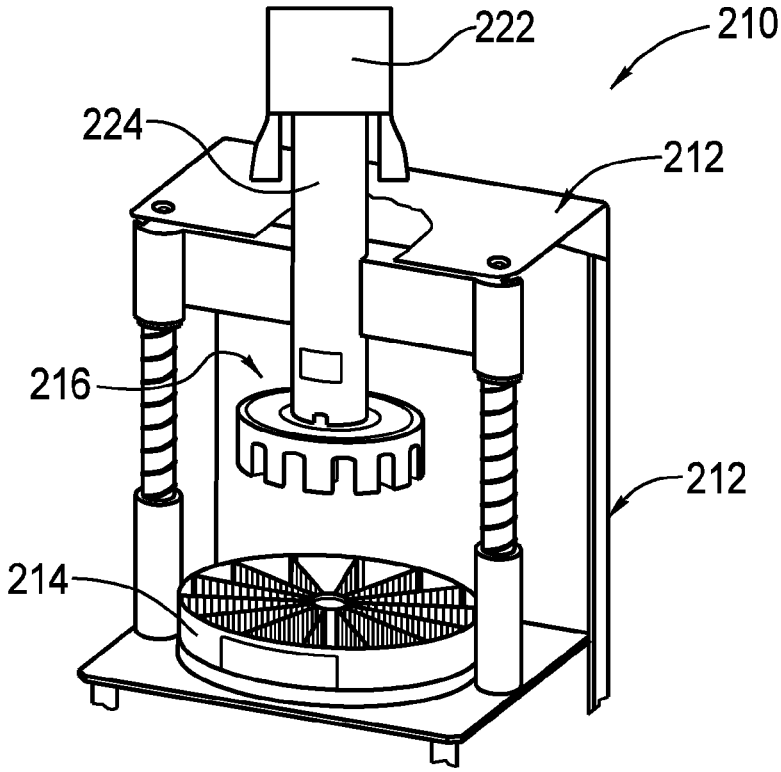
FIG. 2 is a front perspective view of a portion of the sectioning device of FIG. 1 including a pneumatic cylinder.

The sectioning device of FIG. 2 is similar to that illustrated in FIG. 1. Therefore, like elements will be given like numbers preceded by the numeral 2. Referring to FIG. 2, a sectioning device for sectioning food and other items is generally designated by the reference number 210. The sectioning device 210 includes a frame 212 and a cutter 214 removably positioned on the frame. A press assembly 216 is movably positioned on the frame 212 for pushing an item to be sectioned against and through the cutter 214.

The sectioning device 210 includes a pneumatic cylinder 222 mounted on the frame 212. The pneumatic cylinder 222 includes a shaft 224 moveable between an extended and retracted position. The extended position of the shaft 224 corresponds to the above-described sectioning position, while the retracted position of the shaft corresponds to the above-described neutral position. The pneumatic cylinder 222 is controlled via the introduction of pressurized gas from a gas source (not shown). A valve or other actuator (not shown) can also be employed to operate the cylinder. While a pneumatic cylinder has been described, the sectioning device 10 is not limited in this regard as a hydraulic cylinder can also be substituted.

Referring back to FIG. 1, the frame 12 can be manufactured from a substantially rigid material such as metal and includes a base 28, a cover plate 30 and a cutter deck 32 positioned between the base and the cover plate. The frame 12 also includes a backing plate 34. The base 28, the cover plate 30 and the cutter deck 32 are mounted to the backing plate 34 and in the illustrated embodiment are substantially perpendicular thereto. Two legs 36 extend between the cutter deck 32 and the base 28. The frame 12 further includes two guide posts 40 each coupled to the cover plate 30 at one end and to the cutter deck 32 at a generally opposite end. The press assembly 16 includes a support 42 extending between the guide posts 40 and engaged with the guide posts and a cylindrical press shaft 44 which is removably mounted to the support 42. A press module 48 is removably mounted to the press shaft 44. A detent mechanism (not shown) can be employed to retain the press module on the support. While the press module 48 has been described as being removably mounted to the press shaft 44, the sectioning device 10 is not limited in this regard as the press module can also be integral with the shaft.

While the sectioning device 10 is shown as including the frame 12 including the base 28, the cover plate 30, the cutter deck 32 and the backing plate 34, the sectioning device is not limited in this regard as other suitable frame configurations may be employed without departing from the broader aspects of the sectioning device including but not limited to configurations having any number of extensions secured to a base; a one piece molded structure; a structure including components adhesively secured, welded and/or brazed to one another; a collapsible structure; a frame having a splash guard, dust cover and/or safety shield; and a structure comprised of modular components interchangeable with other devices. Moreover, while the frame 12 has been described as being to be manufactured from metal, the sectioning device 10 is not limited in this regard as other materials including plastic, wood and composite materials are also contemplated. While the base 28, the cover plate 30 and the cutter deck 32 are shown stacked substantially parallel to one another with the backing plate 34 substantially perpendicular thereto, the sectioning device 10 is not limited in this regard as the base 28, the cover plate 30, the cutter deck 32 and the backing plate 34 can be configured in other suitable orientations without departing from the broader aspects of the sectioning device.

Figure 3:
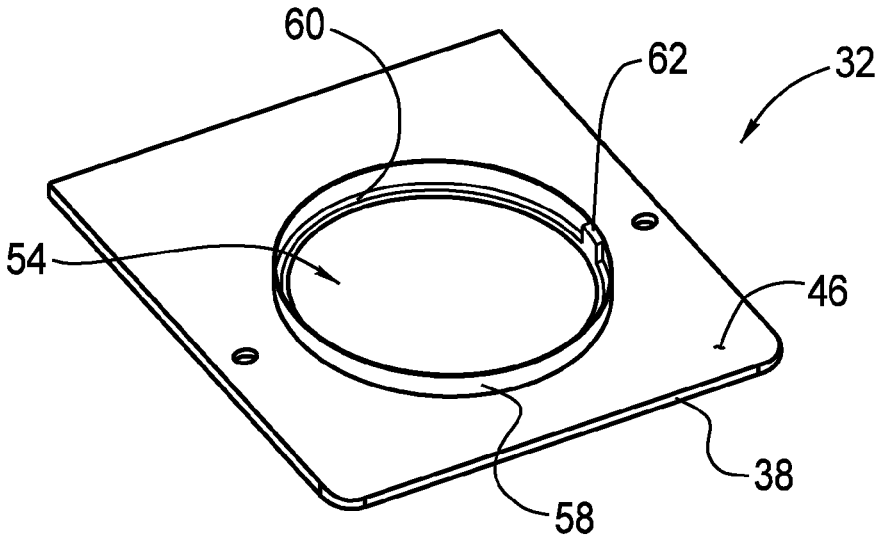
FIG. 3 is a top perspective view of the cutter deck.

As shown in FIGS. 1 and 3 the cutter deck 32 has a substantially circular hole 54 with an annular ring 58 positioned on the cutter deck 32, concentrically with the hole 54 and forming a lip 60 on the cutter deck 32 for removably supporting the cutter 14. A key 62 is fixed to an inner circumference of the ring 58 and the lip 60 for alignment of the cutter 14.

Referring to FIG. 1, the cutter 14 is shown having twelve blades 64 extending radially outward from a circular cutting blade 66 and terminating at and being secured to an inside surface 68 of a retaining ring 70, creating twelve wedge shaped voids 72 and one circular void 74 in the cutter 14. The press module 48 has a contoured form 50, the shape and size of which is complementary to the shape and size of the cutter 14. Accordingly, the contoured form 50 includes twelve wedge shaped fingers 76 which are complementary to the shape and size of the voids 72. In addition, the contoured form 50 is illustrated with a portion thereof cut away thereby showing one circular finger 77 which corresponds in size and shape to the circular void 74. The wedge shaped fingers 76 and the circular finger 77 are in the form of segmented protrusions extending from the contoured form 50. As the press assembly 16 is moved from the neutral position to the sectioning position, the wedge shaped fingers 76 are inserted into the voids 72 and the circular finger 77 is inserted into the circular void 74, thereby forcing an item placed between the cutter 14 and the press module 48, through the cutter 14, in a single continuous motion. In addition, the sectioning device 10 also includes a chute 78 removably secured to the frame 12, for receiving sectioned items and conveying them to a receptacle such as a plate (not shown) placed at the bottom of the chute 78.

While the chute 78 is described for receiving the item from the cutter 14 and conveying the sectioned item to a receptacle, the sectioning device 10 is not limited in this regard as other means for receiving the items and conveying them to a receptacle can also be used including but not limited to; a belt conveyer; a scoop; a rotary conveyor; and an air and/or vacuum conveyer; a belt conveyer; a scoop; a rotary conveyor; an air and/or vacuum conveyer; and allowing the sectioned items to fall directly down from the cutter 14 into a bowl or other receptacle.

Figure 4A:
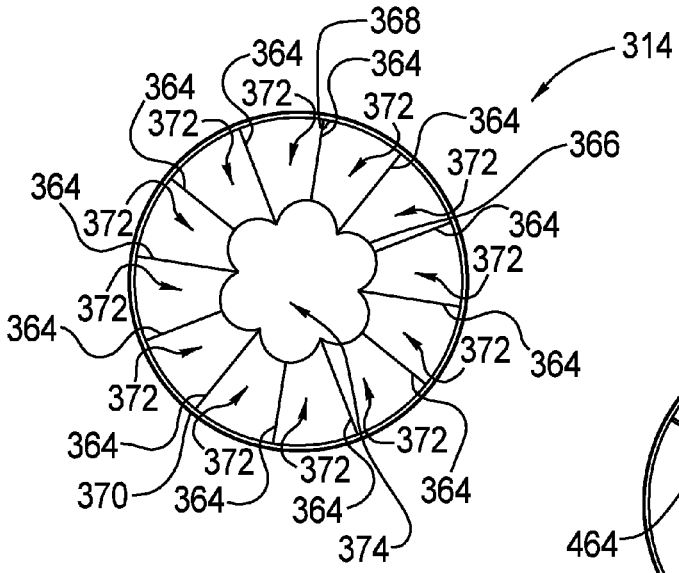
FIG. 4A is a top view of a floral pattern cutter.

The cutter of FIG. 4A is similar to that illustrated in FIG. 1. Therefore, like elements will be given like numbers preceded by the numeral 3. Referring to FIG. 4A, the cutter 314 is shown having twelve blades 364 extending radially outward from a floral pattern cutting blade 366 and terminating at and being secured to an inside surface 368 of a retaining ring 370, creating twelve wedge shaped voids 372 and one floral pattern void 374 in the cutter 314. The press module (not shown) has a lower contoured form (not shown), the shape and size of which is complementary to the shape and size of the cutter 314.

Figure 4B:
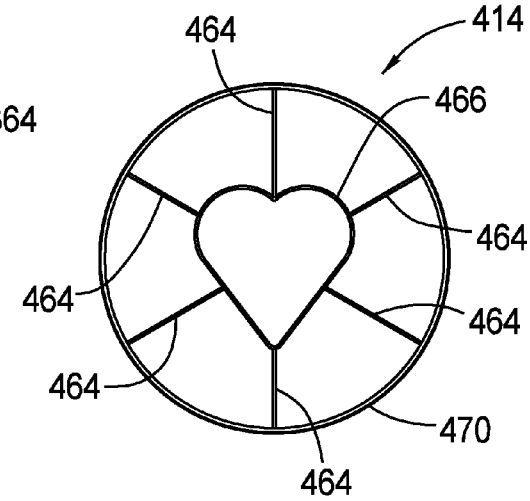
FIG. 4B is a top view of a cutter with a heart shaped pattern.

It should be appreciated that while twelve blades 64, 364 are shown with one circular pattern cutting blade 66 (or a floral pattern cutting blade 366), the sectioning device 10 is not limited in this regard as various different shapes, sizes and number of blades as well as the orientation and/or disposition of the blades may be employed without departing from the broader aspects of the sectioning device. It should also be appreciated that while the cutter 14 and 314 are shown having a circular shape retaining ring 70, 370, other shapes may also be used depending upon the particular application. For example, a cutter 414 illustrated in FIG. 4B having six blades 464 extending radially outward from a heart shaped cutting blade 466 and terminating at and being secured to an inside surface of a retaining ring 470 can also be employed.

Figure 5:
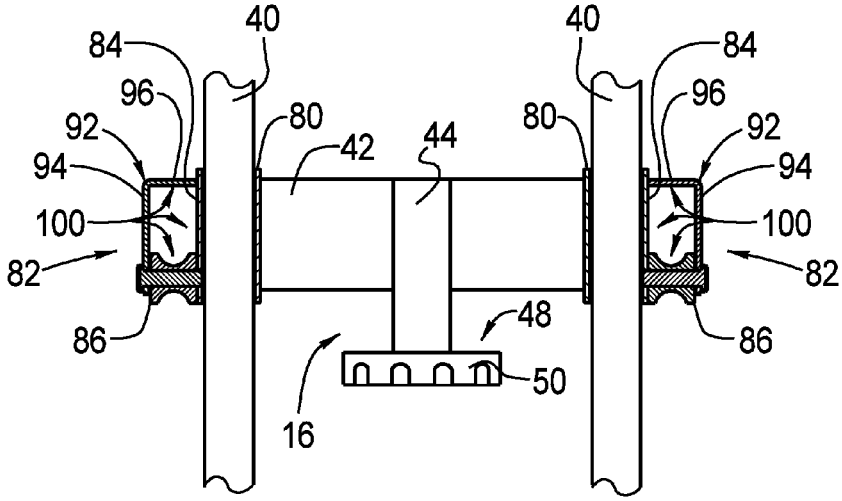
FIG. 5 is a front cross sectional view of the support and a portion of the sectioning device.

Referring to FIGS. 1 and 5, the support 42 includes a substantially cylindrical sleeve 80 secured to opposing ends thereof and in sliding engagement with respective guide posts 40. A roller assembly 82 is positioned on an outwardly facing portion 84 of each of the cylindrical sleeves 80. The roller assemblies 82 each include a roller 86 rotatably mounted on the sleeve 80 with a suitable fastener. Each of the roller assemblies 82 also includes an L-shaped stop plate 92 having a first section 94 and a second section 96 arranged substantially perpendicular to one another and positioned on the cylindrical sleeve 80 with a suitable fastener. Collectively, the roller 86, the stop plate 92 and the cylindrical sleeve 80 define a boundary 100 which limits extraneous movement of the handle 18.

While the roller assembly 82 is described as having roller 86 and a stop plate 92, the sectioning device 10 is not limited in this regard as other means of providing sliding engagement between the handle 18 and portions of the press assembly 16, including but not limited to direct sliding contact between the handle and a portion of the press assembly, the use of sleeves and the use of roller bearing assemblies, can be employed without departing from the broader aspects of the sectioning device.

Figure 7:
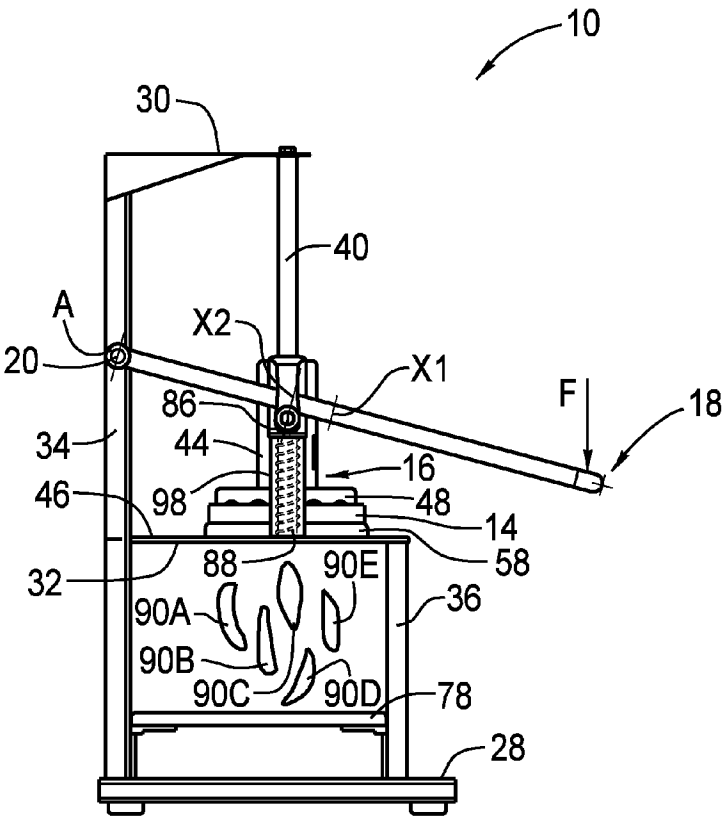
FIG. 7 is a side view of the sectioning device in a sectioning position.
Figure 6:
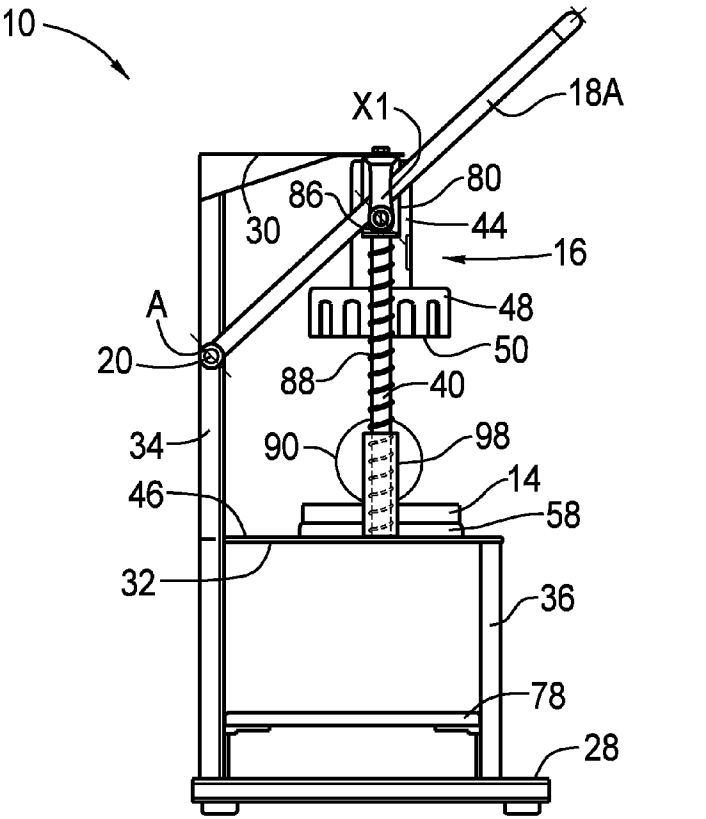
FIG. 6 is a side view of the sectioning device in a neutral position.

Referring to FIG. 6, during operation of the sectioning device 10, an item to be sectioned 90 is placed between the cutter 14 and the press module 48. The press assembly 16 moves in a single continuous motion between a neutral position as shown in FIG. 6 and a sectioning position as shown in FIG. 7, in response to a generally downward force F applied to the handle 18. During the sectioning operation, the item 90 to be sectioned is pushed through the cutter 14 by the press module 48, thereby causing the entirety of the item to be sectioned into sections 90A-E.

As illustrated in FIG. 6, the press assembly 16 is normally urged toward the neutral position by a coil spring 88 wrapped around and slidably mounted on the each of the guide posts 40. A portion of each of the springs 88 is disposed within respective stopper sleeves 98 which are coaxial with the respective guide posts 40 and the springs 88. The stopper sleeves 98 are secured to respective portions of the top side 46 of the cutter deck 32 and limit travel of the press assembly 16.

As the handle 18 moves between the neutral position and the sectioning position, an area of engagement between the handle and the roller 86 moves between points X1 and X2. Accordingly, the mechanical advantage imparted by the handle 18 onto the press assembly 16, increases as the area of engagement moves away from the pivot axis A (i.e., from point X1 to X2).

While the coil spring 88 is said to urge the press assembly towards the neutral position, the sectioning device is not limited in this regard as other biasing means can be adopted including but not limited to the use of any number of coil springs, leaf springs, torsion springs, rubber, elastomeric materials, pneumatic devices and any combination thereof.

While the downward motion of the handle 18 is said to cause the press assembly 16 to move towards the cutter 14, the sectioning device 10 is not limited in this regard as other configurations are also suitable including but not limited to having the cutter 14 move towards a stationary press assembly and having both the cutter and the press assembly move towards each other.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description.

What is claimed is:

1. A sectioning device comprising;

a frame;

a cutter deck carried by said frame, said cutter deck defining an aperture;

a cutter removably carried by said cutting deck;

said cutter including cutting blades for cutting an object encountering said cutting blades;

said cutting blades being offset from one another defining a plurality of cavities and said cutting blades being aligned with said aperture of said cutting deck enabling an object to be cut and pass through said cutting deck;

a press for pushing an item against and through said cutter, said press including a press module removably carried by a press shaft, said press module including a plurality of fingers corresponding with said cavities of said offset cutting blades for engaging an object to be cut and pressing said object through said respective offset cutting blade resulting in the object being cut by the respective cutting blades, and a press support having a first and second end;

a first and a second press guide post carried by the cutting deck;

said press support being slidably carried by said first and second press guide posts;

an actuator for sliding said press support along a portion of the length of said first and second press guide posts simultaneously for manipulating said plurality of fingers through said cutting blades thereby cutting an object; and said actuator including a handle having a left and a right handle portion interconnected with a central portion, said left handle portion pivotally carried by said frame on a first side and said right handle portion pivotally carried by said frame on an opposite side; and said left and right handle portions each slidably engaging with a roller mounted on each end of said press support; and wherein each end of said press support further includes a stop plate; wherein said rollers and said stop plates define a movement boundary of said left and right handle portion; and wherein said left and right handle portions communicating with said rollers provided at each end of said press support to enable a downward force applied to said central portion of said handle to translate to simultaneous downward movement of said press support along said first and second press guide posts.

* * * * *